United States Patent [19]

Nilssen

[11] Patent Number: 5,027,032

[45] Date of Patent: Jun. 25, 1991

[54] ELECTRONICALLY CONTROLLED MAGNETIC FLUORESCENT LAMP BALLAST

[76] Inventor: Ole K. Nilssen, Caesar Dr., Barrington, Ill. 60010

[21] Appl. No.: 488,366

[22] Filed: Feb. 20, 1990

Related U.S. Application Data

[63] Continuation of Ser. No. 788,863, Oct. 18, 1985, abandoned.

[51] Int. Cl.[5] ..... H05B 41/04

[52] U.S. Cl. ..... 315/103; 315/106; 315/200 R; 315/DIG. 7

[58] Field of Search ..... 315/70, 103, 105, 106, 315/200 R, DIG. 7

[56] References Cited

U.S. PATENT DOCUMENTS

| | | | |
|---|---|---|---|
| 3,818,312 | 6/1974 | Luursema et al. | 315/219 |
| 4,256,992 | 3/1981 | Luursema | 315/106 |
| 4,523,131 | 6/1985 | Zansky | 315/219 |
| 4,588,924 | 5/1986 | Luursema et al. | 315/96 |
| 4,613,934 | 9/1986 | Pacholok | 315/DIG. 7 |

FOREIGN PATENT DOCUMENTS 2458200 12/1980 France .

*Primary Examiner*—David Mis

[57] ABSTRACT

A magnetic-type ballast powers two series-connected fluorescent lamps from a 277 Volt power line. Except when the lamps are loading the ballast, an electronic control circuit provides an intermittently interrupted short circuit across the two lamps: providing for socket voltages high enough to permit lamp ignition for a period of about 25 milli-seconds every two seconds or so, but keeping the average socket voltages low enough to satisfy safety requirements.

When initially connecting power to the lamp-ballast combination, the control circuit enters its short circuit state and remains there for two seconds. Then, after two seconds, the control circuit switches into an open circuit, thereby permitting the voltage across the lamps to become high enough to cause lamp starting within a few milli-seconds. If the lamps fail to start, the electronic circuit reverts back to a short circuit within 25 milli-seconds.

Normally the lamps do start, thereby causing a reduction in the voltage across the lamps compared with pre-starting. Due to this voltage reduction, the electronic circuit changes its mode into a continuous open circuit state.

The electronic control circuit comprises a bridge rectifier and a push-pull inverter that can be triggered into and out of self-oscillation. When the inverter oscillates, it acts as an short circuit, while also providing heating power for all lamp cathodes. When not oscillating, it acts as an open circuit.

22 Claims, 2 Drawing Sheets

ELECTRONICALLY CONTROLLED MAGNETIC FLUORESCENT LAMP BALLAST

RELATED APPLICATION

This application is a continuation of application Ser. No. 06/788,863 filed Oct. 18, 1985, now abandoned.

BACKGROUND OF THE INVENTION

1. Field of Invention

The invention relates to high-efficiency magnetic-type ballasts for fluorescent lamps, particularly of a type using electronic means to control the ballasting function.

2. Prior Art and General Background

It is well known that significant improvements in luminous efficacy of fluorescent lighting can be attained by way of using high-frequency electronic ballasts, especially in connection with also using special high-efficacy fluorescent lamps.

Used with ordinary F40/T12 four-foot fluorescent lamps, a good quality high-frequency electronic ballast provides for an overall improvement in luminous efficacy of about 25%. Also using high-efficacy lamps can yield an additional 25% improvement—for an overall efficacy improvement of about 44%.

However, the complexity and relatively high cost of high-frequency electronic ballasts constitute a significant impediment against their widespread use, thereby providing an incentive for finding alternative high-efficiency ballasting means.

SUMMARY OF THE INVENTION

Objects of the Invention

A first object of the present invention is that of providing high-efficiency magnetic ballasts for powering fluorescent lamps.

A second object is that of providing in such magnetic ballasts some means by which the heating power for the lamp cathodes can be removed or at least significantly reduced after the fluorescent lamps have ignited.

These as well as other objects, features and advantages of the present invention will become apparent from the following description and claims.

Brief Description

In its preferred embodiment, the present invention constitutes a magnetic-type ballast powered from an ordinary 277Volt/60Hz electric utility power line and adapted to start and operate two series-connected F40/T12 four foot fluorescent lamps. Except when the lamps are properly loading the ballast output, an electronic control circuit provides an intermittently interrupted short circuit across this ballast output.

The effect of this intermittently interrupted short circuit is that of providing every two seconds or so a maximum ballast output voltage high enough to permit lamp ignition, while keeping the average ballast output voltage low enough to reasonably satisfy safety requirements.

When initially connecting power to the lamp-ballast arrangement, the electronic control circuit enters its short circuit state almost immediately and remains there for about two seconds, during which period heating power is applied to the lamp cathodes. Then, after two seconds, when the cathodes have reached full thermionic emission, the control circuit switches into a state of an open circuit, thereby permitting the voltage at the ballast output to reach a magnitude large enough to provide for lamp ignition within a few milli-seconds. If the lamps fail to start, the electronic control circuit will revert back to a short circuit within about 25 milliseconds.

Normally the lamps do start, thereby causing a reduction in the magnitude of the voltage at the ballast output. As a result of this reduction in voltage, the electronic control circuit changes its mode from an intermittently interrupted short circuit to a continuous open circuit.

The electronic control circuit comprises a bridge rectifier connected across the ballast output, and a push-pull inverter connected across the DC output of this bridge rectifier. The inverter can be triggered into and out of oscillation. Whenever the inverter oscillates, it acts effectively as a short circuit, while also providing heating power for all lamp cathodes. When not oscillating, the inverter acts as an open circuit. Thus, when lamps operate in their normal mode, no cathode heating power is provided; while during the starting process, full cathode heating power is provided.

All required lamp starting and operating voltages are attained without the use of transformer means, which results in substantial improvements in basic ballast efficiency. The removal of cathode heating power after lamp ignition provides for substantial additional efficiency improvement.

DESCRIPTION OF THE PREFERRED EMBODIMENT

Details of Construction

Figure 1:
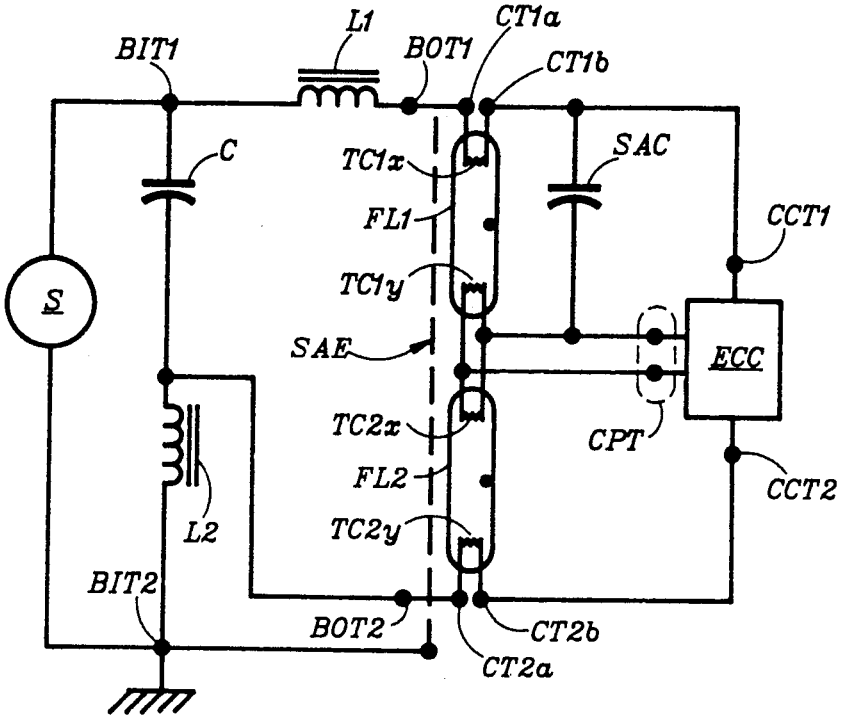
FIG. 1 diagrammatically illustrates the preferred embodiment of the invention.

In FIG. 1, a source S of 277Volt/60Hz voltage is connected across ballast input terminals BIT1 and BIT-2—with terminal BIT2 being connected with the grounded side of the source.

A first inductor L1 is connected between terminal BIT1 and a ballast output terminal BOT1, which is then connected with a first cathode terminal CT1a of a first thermionic cathode TC1x of a first fluorescent lamp FL1. A second thermionic cathode TC1y of fluorescent lamp FL1 has two terminals; which two terminals are connected with two terminals of a first thermionic cathode TC2x of a second fluorescent lamp FL2. A first cathode terminal CT2a of a second thermionic cathode TC2y of lamp FL2 is connected with a second ballast output terminal BOT2. A second inductor L2 is connected between terminals BOT2 and BIT2.

A capacitor C is connected between terminals BIT1 and BOT2.

A second cathode terminal CT1b of thermionic cathode TC1x is connected to first control circuit terminal CCT1 of electronic control circuit ECC. A second control circuit terminal CCT2 of electronic control circuit ECC is connected with a second cathode terminal CT2b of thermionic cathode TC2y.

A pair of cathode power terminals CPT on electronic control circuit ECC is connected with the terminals of thermionic cathodes TC1y and TC2x.

A starting aid capacitor SAC is connected between one of the terminals of cathode TC1x and one of the terminals of cathode TC1y. A starting aid electrode SAE is positioned adjacent the fluorescent lamps and electrically connected with the grounded side of the source.

Figure 2:
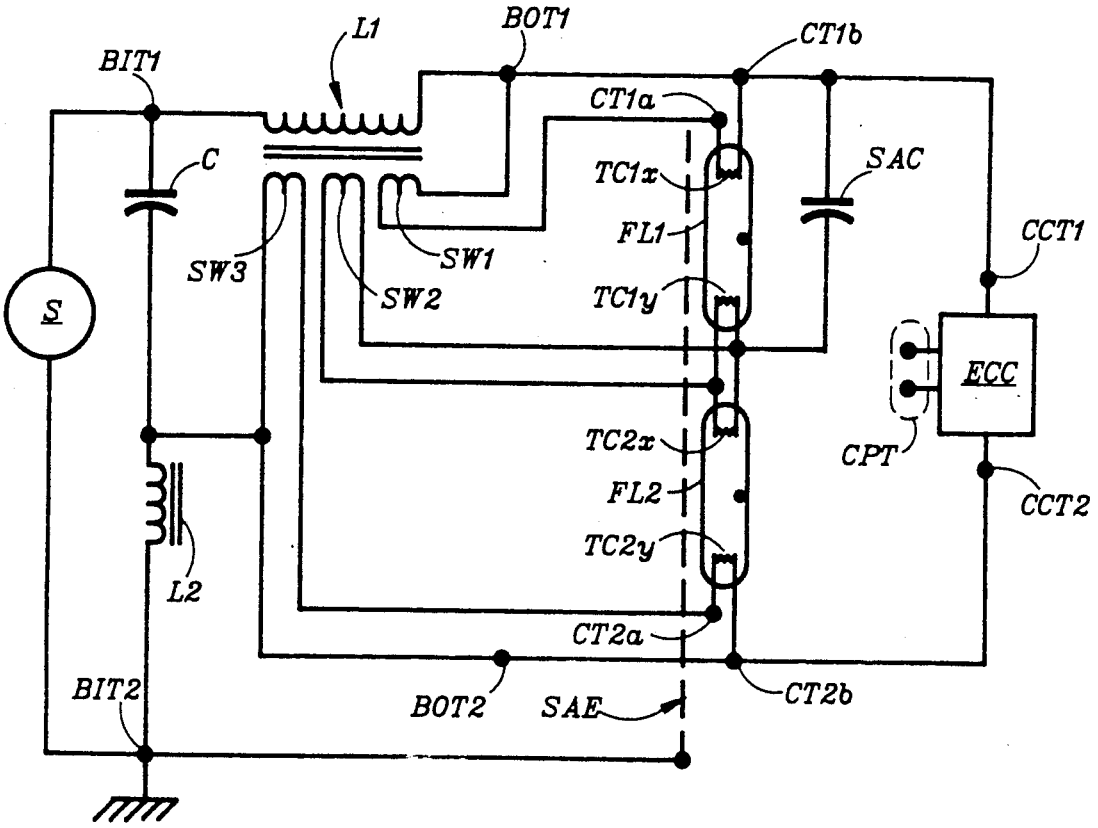
FIG. 2 shows a modified version of the invention.

FIG. 2 shows an arrangement that is substantially identical to that of FIG. 1 except for: i) having removed the connection between cathode power terminals CPT and cathodes TC1y and TC2x, and ii) having three secondary windings SW1, SW2, and SW3 tightly coupled with inductor L1—with these secondary windings respectively being connected with the terminals of cathode TC1x, with the terminals of cathodes TC1y and TC2x, and with the terminals of cathode TC2y.

Figure 3:
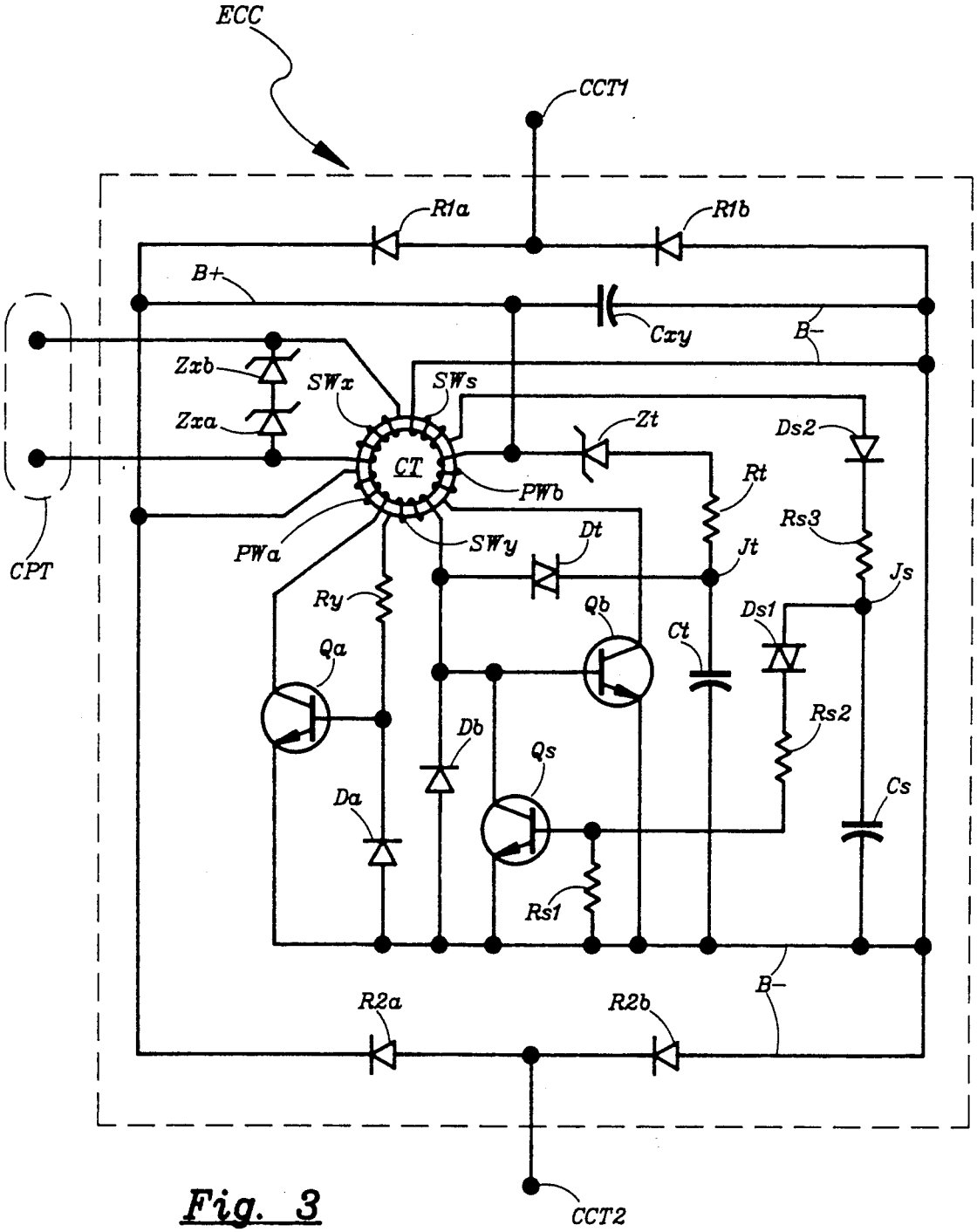
FIG. 3 represents a circuit diagram of the electronic control circuit used for providing a controllable short circuit across the ballast output.

FIG. 3 represents a circuit diagram of electronic control circuit EEC with its control circuit terminals CCT1 and CCT2, as well as its cathode power terminals CPT.

A rectifier R1a is connected with its anode to the CCT1 terminal and with its cathode to a B+ bus; and a rectifier R1b is connected with its cathode to the CCT1 terminal and with its anode to a B− bus.

Similarly, a rectifier R2a is connected with its anode to the CCT2 terminal and with its cathode to the B+ bus; and a rectifier R2b is connected with its cathode to the CCT2 terminal and with its anode to the B− bus.

A capacitor Cxy is connected between the B+ bus and the B− bus.

Transistors Qa and Qb are both connected with their emitters to the B− bus. The collector of transistor Qa is connected with the B+ bus by way of primary winding PWa of a current transformer CT; and the collector of transistor Qb is connected with the B+ bus by way of primary winding PWb of current transformer CT.

A first Zener diode Zxa is connected with its anode to the anode of a second Zener diode Zxb to form a series-combination; and this series-combination is connected across the output terminals of a secondary winding SWx of current transformer CT. The terminals of secondary winding SWx are also connected with cathode power terminals CPT.

Another secondary winding SWy of CT is connected in series with a resistor Ry to form a series-combination; and this series combination is connected between the bases of transistors Qa and Qb.

A first diode Da is connected with its cathode to the base of transistor Qa and with its anode to the B− bus; and a second diode Db is likewise connected with its cathode to the base of transistor Qb and with its anode to the B− bus.

A transistor Qs is connected with its collector to the base of transistor Qb and with its emitter to the B− bus. A resistor Rs1 is connected between the base and emitter of Qs.

A resistor Rs2 is connected in series with a Diad Ds1 to form a series-combination, and this series-combination is connected between a junction Js and the base of transistor Qs.

Still another secondary winding SWs of transformer CT is connected between the B− bus and the anode of a diode Ds2. The cathode of diode Ds1 is connected with one terminal of a resistor Rs3, and the other terminal of this resistor Rs3 is connected with junction Js.

A capacitor Cs is connected between junction Js and the B− bus.

A Zener diode Zt is connected with its cathode to the B+ bus and with its anode to one terminal of a resistor Rt. The other terminal of resistor Rt is connected with a junction Jt.

A Diac Dt is connected between junction Jt and the base of transistor Qb.

A capacitor Ct is connected between junction Jt and the B− terminal.

Details of Operation

The operation of the circuit of FIG. 1 may be explained as follows.

In FIG. 1, the source S represents an ordinary 277Volt/60Hz electric utility power line, the voltage from which is applied directly to the input terminals BIT1/BIT2 of the ballast.

Capacitor C is principally used for power factor correction during normal operation of the ballast. However, in combination with inductor L2, it is also used for establishing a relatively low-magnitude 60 Hz AC voltage at ballast output terminal BOT2; which low-magnitude voltage is mainly productive of providing an increased-magnitude starting voltage for the two lamps. In this connection, it is noted that the magnitude of the current flowing through the series-combination of C and L2 is principally established by the reactance of C, and that the magnitude of the voltage established across L2 is principally determined by the magnitude of this capacitive current in combination with the magnitude of the inductive reactance of L2.

In particular, in the preferred embodiment—for operation on a 277Volt/60Hz power line and with two more-or-less ordinary F40/T12 four foot fluorescent lamps connected to the ballast output—the magnitude of the relatively low-magnitude voltage established across L2 is about 23 Volt. Considering terminal BIT2 as the reference, this means that a 23Volt/60Hz will be provided at terminal BOT2—with the phasing of this 23Volt/60Hz voltage being opposite to that of the 277Volt/60Hz voltage provided at terminal BIT1.

Thus, the magnitude of the total net starting voltage provided across the two fluorescent lamps—i.e., between terminals BOT1 and BOT2—is about 300 Volt, which is adequate to permit proper rapid-starting of two series-connected four foot fluorescent lamps.

Starting aid electrode SAE and starting aid capacitor SAC are common elements used in connection with rapid-starting of two series-connected fluorescent lamps.

The part of the total ballast arrangement so far described would operate perfectly well as a rapid-start ballast, except for two important factors, namely cathode heating and safety from electric shock hazard.

Cathode heating could readily be provided by way of placing three secondary windings on inductor L2. However, the issue of safety from shock hazard would still not have been resolved. Moreover, providing cathode heating from secondary windings on L2 would provide for continuous cathode heating; which would not be conducive to maximum ballast operating efficiency.

In the arrangement of FIG. 1, cathode heating is obtained as follows.

a) For cathodes TC1x and TC2y, it is accomplished in the manner normally associated with pre-heat fluorescent lamp starting. That is, the ballast current that results when electronic control circuit ECC is in a state of short circuit is passed through cathodes TC1x and TC2y, thereby providing for the requisite cathode heating.

b) For cathodes TC1y and TC2x, cathode heating power is obtained directly from electronic control circuit ECC, but only while it exists in a state of short circuit.

Otherwise, with reference to FIG. 3, electronic control circuit ECC functions as follows.

c) When the full ballast starting voltage (namely about 300Volt/60Hz) is placed across terminals CCT1 and CCT2, a corresponding DC voltage gets established between the B+ bus and the B− bus within the ECC. The magnitude of this DC voltage is high enough to cause current to flow through Zener diode Zt, with the result that—within about 25 milli-seconds (the length of time being determined in part by the value of resistor Rt)—capacitor Ct charges up to a voltage of magnitude high enough to cause Diac Dt to break down, thereby causing a trigger pulse to be provided at the base of transistor Qa; which trigger pulse then initiates inverter oscillation.

d) When oscillating, the inverter is in effect powered from a current source and loaded by a current transformer (i.e., CT), and the main loading of this current transformer is that of the cathode heating power provided at terminals CPT—or, if no cathodes were to be connected with CPT, the power absorbed by the two series-connected Zener diodes Zxa and Zxb. (Without these Zener diodes, and since it is powered by a current source, the inverter would be apt to self-destroy if the cathode load were removed.)

e) With the inverter oscillating, the magnitude of the DC voltage between the B+ bus and the B− bus falls to a very low level—a level just sufficient to provide for the cathode heating power in addition to the relatively small amount of power required to cause the transistors to switch.

f) When the inverter oscillates, a tiny amount of power is also extracted from the current transformer by secondary winding SWs; and the purpose of this power is that of slowly charging capacitor Cs. Eventually, after about two seconds or so, the magnitude of the voltage on Cs reaches a level sufficient for Diac Ds1 to break down.

When Diac Ds1 breaks down, a pulse is provided to the base of transistor Qs, which then—for a period of about one milli-second—is switched into a conductive state, thereby providing an effective momentary short circuit between the base and the emitter of transistor Qa. This momentary short circuit causes the inverter to cease oscillating; which, in turn, causes the voltage between the CCT1/CCT2 terminals to rise to the initial 300 Volt magnitude.

g) At this point, all the lamp cathodes have reached the point of thermionic emission (i.e., incandescence); and—with a 300Volt/60Hz starting voltage being provided—the lamps now ignite within a few milliseconds.

h) After the lamps have ignited, the magnitude of the voltage across the ECC1/ECC2 terminals drops by a substantial amount—to a level determined principally by lamp characteristics and being typically about 200 Volt with peak voltages staying below 250 Volt.

i) Thus, with Zener diode Zt having a Zener voltage of about 250 Volt, no charging of capacitor Ct takes place after the lamps have ignited; which implies that the inverter within ECC will remain in a non-oscillating mode for as long as the lamps operate in a normal manner.

j) If the lamps fail to ignite, the magnitude of the voltage across the CCT1/CCT2 terminals immediately reverts back to about 300 Volt—with peaks of about 420 Volt—and, within about 25 milli-seconds, the inverter will be triggered into oscillation, thereby providing for an effective short circuit across the lamps.

k) If the lamps continue to fail to ignite, the electronic control circuit will continue to provide a short circuit across the ballast output terminals—except that this short circuit will be interrupted every two seconds or so with a 25 millisecond period of open circuit.

l) As long as the lamps remain in operation, the electronic control circuit remain an effective open circuit. Thus, no cathode heating power is provided as long as the lamps operate.

The arrangement of FIG. 2 provides for an alternative version of the invention.

This version operates in a manner that is substantially identical to that of the arrangement of FIG. 1, except that a relatively small amount of cathode heating power continues to be provided while the lamps operate.

It is noted that—while the electronic control circuit ECC is in its short circuit mode—the magnitude of the voltage present across the L1 inductor is about 300 Volt; whereas, when the lamps are in operation, the magnitude of the voltage across the L1 inductor is only about 225 Volt. Thus, the power provided to the cathodes during the operating mode is only about half that provided during the starting mode; which implies that about half of the normally required cathode heating power is being saved.

Additional Comments

1. The operation of the inverter within the electronic control circuit ECC is well known and described in detail in prior art references, such as in U.S. Pat. No. 4,279,011 to Nilssen.

2. The basic ballast circuit configuration of FIG. 1 is applicable to 120Volt/60Hz power line voltage as well. However, to attain adequately high starting and operating voltages for two series-connected fluorescent lamps, it is necessary to increase the magnitude of the voltage developed across inductor L2 to about 180 Volt.

3. Using ballast terminal BIT2 as a reference, the RMS magnitude of the voltage provided at the TC1x cathode in situations when lamp current is not flowing is about 30 Volt or less; which should be adequately low to meet with reasonable shock hazard safety requirements.

4. In the ballasting circuit of FIG. 1, it is readily possible to provide additional protection against electric shock hazard in a situation where a person might have a fluorescent lamp inserted into its socket in such a way that one of the lamp's cathodes is connected to the "hot" side of the ballast output (i.e., the side to which the TC1x cathode is connected) while at the same time this person has contact with ground (i.e., with the BIT2 terminal) and is holding onto the terminals of the other cathode of the lamp. In this situation, to prevent the lamp from igniting and then to send lamp current flowing through the person to ground, it is simply sufficient to prevent the cathode on the "hot" side of the ballast output from receiving cathode heating power; which can readily be accomplished by connecting the CCT1 terminal with the CT1a terminal instead of with the CT1b terminal—leaving the CT1b terminal essentially without connection. That way, except when the lamp is actually carrying current, the CT1b cathode will be non-thermionic—with the result that a voltage of far larger than normal magnitude is required for igniting the lamp.

In fact, about 430 Volt RMS is for starting an F40/T12 four foot fluorescent lamp with cold cathodes. Moreover, this voltage must have a chance to act over a period longer than about 25 milli-seconds.

In this connection, it is noted that the absence of cathode heating power on one of a lamp's two cathodes only gives rise to a slight impairment of the lamp's starting characteristics; and it has no net substantive effect on its operating characteristics.

To compensate for this slight impairment in starting characteristics, the magnitude of the voltage at terminal BOT2 may be increased by a relatively modest amount. Or, the length of the 25 milli-second lamp starting period may be increased.

5. In the ballast circuit of FIG. 2, in view of the reasoning presented above, it is in fact permissible to eliminate secondary winding SW1, and instead provide a short circuit between cathode terminals CT1a and CT1b. Again, to compensate for the slightly impaired lamp starting characteristics, the magnitude of the voltage at terminal BOT2 may be increased.

6. According to the specifications of Underwriters Laboratories (U.L.) relative to Ground-Fault Circuit Interrupters, circuit shut-down within 25 milli-seconds is considered adequate even in response to a large-magnitude groundfault current; which, to a significant degree, accounts for the choice of 25 milli-seconds as the response time of electronic control circuit ECC. That is, especially in the arrangement of FIG. 2, electronic control circuit ECC functions as a means for protecting a person (who might be in contact with ground while holding onto one end of a fluorescent lamp while sticking the other end of the lamp into a lamp socket) against excessive flow of ground-fault current from the fluorescent lamp socket.

7. In the arrangement of FIG. 1, electronic control circuit ECC exhibits a function that in some respects is similar to that of an ordinary fluorescent lamp starter. However, it should be noted that, in case of an ordinary fluorescent lamp starter, the ratio between the length of the period during which the starter constitutes a short circuit and the length of the period during which it constitutes an open circuit, is on the order of one-to-one. In case of electronic control circuit ECC, on the other hand, this ratio is far larger—at least on the order of ten-to-one, and more reasonably on the order of sixty-to-one.

8. In the arrangements of FIGS. 1 and 2, the fluorescent lamps are started in rapid-start manner; which, in sharp contrast with ordinary pre-heat fluorescent lamp operation, implies that lamp ignition is not dependent on an inductive "kick".

9. Rapid-start fluorescent lamp operation is defined as a way of starting the fluorescent lamp that requires: i) that its cathodes be incandescent, but without establishing initial gas ionization across the lamp cathodes due to the application of relatively high-magnitude cathode heating voltage (as is done in pre-heat operation); ii) that initial gas ionization be established by way of a starting aid electrode means, such as an adjacently positioned ground plane, and iii) that an adequately large voltage be present across the lamp for a relatively extended period, which period might be on the order of 25 milli-seconds after cathodes have reached incandescence, which period is substantially longer than the duration of the inductive "kick" normally associated with pre-heat lamp starting.

10. In the arrangement of FIG. 1, the two "outboard" cathodes are heated by the current going through the electronic control circuit, while the two "inboard" cathodes are heated by high frequency voltage from the ECC. However, in another preferred embodiment, the "outboard" cathodes are also heated by high frequency voltage from the ECC.

11. In both FIGS. 1 and 2, the magnitude of the voltage provided across the two fluorescent lamps is too low to cause lamp ignition, even with hot cathodes, without the use of a starting aid electrode.

Of course, by depending on the inductive "kick" that might result when the electronic control circuit makes a transition from short circuit to open circuit, lamp ignition could be accomplished without the use of other starting aid. However, the magnitude of this "kick" depends entirely on the timing of the moment that this transition occurs; which implies that this inductive "kick" can not be reliably counted on for lamp starting.

12. In FIG. 2, if the fluorescent lamps do not ignite, the voltage present across the lamps will alternate between zero and full open circuit voltage—the full open circuit voltage being present for about 25 milli-seconds each 1.5 seconds or so—that is, for a ratio of about one-in-sixty. Thus, the RMS magnitude of the voltage across the lamps will be reduced by a ratio equal to the square root of sixty.

13. It is believed that the present invention and its several attendant features and advantages will be understood from the preceding description. However, without departing from the spirit of the invention, changes may be made in its form and in the construction and interrelationships of its component parts, the forms herein presented merely representing the presently preferred embodiments.

I claim:

1. An arrangement characterized by comprising:

a) impedance means connected with a source of electric power and operative to provide a current-limited supply voltage across a pair of ballast terminals;

b) gas discharge lamp means having a pair of lamp terminals and being connected with the ballast terminals by way of these lamp terminals; the gas discharge lamp means including at least two individual gas discharge lamps; the lamp means being operative to exist in either of two states: i) a pre-ignition state during which no substantial amount of current flows through the lamp means; and ii) a post-ignition state during which a substantial amount of current does flow through the lamp means; the lamp means having at least one thermionic cathode with a pair of cathode terminals which are electrically isolated from the ballast terminals during the pre-ignition state; and c) control means connected with the ballast terminals and operative to exist in either of two modes: i) a first mode existing throughout the pre-ignition state and during which the control means alternates between relatively brief periods of effectively constituting an open circuit and relatively long periods of effectively constituting a short circuit, while also during these relatively long periods providing cathode heating power to the thermionic cathode by way of the cathode terminals; and ii) a second mode existing throughout the post-ignition period and during which the control means effectively constitutes a continuous open circuit;

and by being operative to:

1. cause the thermionic cathode to become hot and thereby operative to permit effective ignition of the lamp means; and
2. cause the lamp means to ignite during one of the relatively brief periods and thereby to enter the second state.

2. The arrangement of claim 1 and means operative to cause the cathode heating power to be absent throughout the second state.

3. The arrangement of claim 1 wherein the cathode heating power is provided in the form of a voltage of frequency substantially higher than that of the supply voltage.

4. The arrangement of claim 1 wherein the duration of each of the relatively long periods is at least ten times longer than the duration of each of the relatively brief periods.

5. An arrangement characterized by comprising:

a) impedance means connected with a source of electric power and operative to provide a current-limited AC supply voltage across a pair of ballast terminals; the AC supply voltage being characterized by having a cycle period;

b) gas discharge lamp means having a pair of lamp terminals and being connected with the ballast terminals by way of these lamp terminals; the lamp means being operative to exist in either of two states: i) a pre-ignition state during which no substantial amount of current flows through the lamp means; and ii) a post-ignition state during which a substantial amount of current does flow through the lamp means; the lamp means having a thermionic cathode with a pair of cathode terminals; and c) control means connected with the ballast terminals and operative to exist in either of two modes: i) a first mode existing throughout the pre-ignition state and during which the control means alternates between relatively brief periods of effectively constituting an open circuit and relatively long periods of effectively constituting a short circuit, while also during these relatively long periods providing cathode heating power to the thermionic cathode by way of the cathode terminals, each relatively brief period having a duration substantially longer than half the duration of said cycle period; and ii) a second mode existing throughout the post-ignition period and during which the control means effectively constitutes a continuous open circuit;

and by being operative to:

1. provide cathode heating power for the cathode, thereby to cause the cathode to become hot and thereby operative to permit effective ignition of the lamp means; and
2. cause the lamp means to ignite during one of the relatively brief periods and thereby to enter the second state, the ignition taking place regardless of the particular moment in time at which this one relatively brief period starts.

6. The arrangement of claim 5 wherein the cathode heating power is caused to be absent throughout the second state.

7. The arrangement of claim 5 wherein the cathode is electrically isolated from the ballast terminals during the pre-ignition state.

8. The arrangement of claim 5 wherein the RMS magnitude of the voltage provided across the ballast terminals, as averaged over a period of at least one second, is lower before the lamp means ignites as compared with after is has ignited.

9. The arrangement of claim 5 wherein the cathode heating power is provided in the form of a voltage of frequency substantially higher than that of the supply voltage.

10. An arrangement characterized by comprising:

a) impedance means connected with a source of AC voltage and operative to provide a current-limited AC supply voltage across a pair of ballast terminals;

b) gas discharge lamp means having a pair of lamp terminals and being connected with the ballast terminals by way of these lamp terminals; the lamp means being operative to exist in either of two states: i) a pre-ignition state during which no substantial amount of current flows through the lamp means; and ii) a post-ignition state during which a substantial amount of current does flow through the lamp means; and c) control means connected with the ballast terminals and operative to exist in either of two modes: i) a first mode existing throughout the pre-ignition state and during which the control means alternates between relatively brief periods of effectively constituting an open circuit and relatively long periods of effectively constituting a short circuit, while also during these relatively long periods providing cathode heating power to the thermionic cathode by way of the cathode terminals, this cathode heating power being provided in the form of a cathode voltage of frequency substantially higher than that of the AC supply voltage, the cathode heating power being provided by way of a frequency conversion means included as part of the control means; and ii) a second mode existing throughout the post-ignition period and during which the control means effectively constitutes a continuous open circuit;

and by being operative to:

1. cause the thermionic cathode to become hot and thereby operative to permit effective ignition of the lamp means; and
2. cause the lamp means to ignite during one of the relatively brief periods and thereby to enter the second state.

11. The arrangement of claim 10 and means operative to cause the cathode heating power to be absent throughout the second state.

12. The arrangement of claim 10 wherein the duration of each of the relatively long periods is at least ten times longer than the duration of each of the relatively brief periods.

13. An arrangement characterized by comprising:

a) impedance means connected with a source of AC voltage and operative to provide a current-limited AC supply voltage across a pair of ballast terminals;

b) gas discharge lamp means having a pair of lamp terminals and being disconnectably connected with the ballast terminals by way of these lamp terminals; the lamp means being operative to exist in either of two states: i) a pre-ignition state during which no substantial amount of current flows through the lamp means; and ii) a post-ignition state during which a substantial amount of current does flow through the lamp means; and c) control means connected with the ballast terminals and operative to exist in either of two modes: i) a first mode existing throughout the pre-ignition state as well as throughout any period when the lamp means may be non-connected with the ballast terminals, during which first mode the control means alternates between relatively brief periods of effectively constituting an open circuit and relatively long periods of effectively constituting a short circuit, and ii) a second mode existing only when the lamp means is connected and then only during the post-ignition period, during which the second mode the control means effectively constitutes a continuous open circuit.

14. The arrangement of claim 13 wherein:

i) the RMS magnitude of the voltage provided across the ballast terminals, absent the control means, is so large as to constitute a serious electric shock hazard to a person involved in connecting the lamp means with the ballast terminals, and ii) wherein the control means is operative, during any period when the lamp means may not be fully connected, to prevent the RMS magnitude of the voltage actually present across the ballast terminals from becoming so large as to represent a serious electric shock hazard to a person involved in connecting the lamp means with the ballast terminals.

15. The arrangement of claim 13 wherein:

i) the lamp means has thermionic cathode means, and ii) the control means is operative to provide cathode heating power to the thermionic cathode means.

16. The arrangement of claim 15 wherein the cathode heating power is provided in the form of a voltage of frequency substantially higher than that of the supply voltage.

17. An arrangement for powering a gas discharge lamp means having a pair of lamp terminals, comprising:

a) impedance means connected with a source of AC voltage and operative to provide a manifestly current-limited AC supply voltage across a pair of ballast terminals, these ballast terminals being adapted for connection with the lamp terminals, the AC supply voltage having an open circuit magnitude that is so large as to represent a serious electric shock hazard to a person involved with connecting or disconnecting the lamp terminals with/-from the ballast terminals; and b) control means connected in circuit with the impedance means and, whenever a lamp means is not connected with the ballast terminals, operative: i) to cause the magnitude of the voltage present across the ballast terminals to cyclically alternate between a relatively brief period of relatively high magnitude and a relatively long period of relatively low magnitude, and in such manner as to cause the relatively high magnitude to exist for no more than about 25 mill-seconds before being reduced to the relatively low magnitude;

and functioning such that the voltage provided across the ballast terminals is prevented from representing a serious electric shock hazard to a person attempting to connect or disconnect the lamp means with/-from the ballast terminals.

18. Control means for a gas discharge lamp ballast having a pair of ballast terminals, comprising:

input terminals operative to connect with the ballast terminals;

shorting means connected in circuit with the input terminals and conditionally operative: i) to cause an effective short circuit to occur between the input terminals, this short circuit occurring only after the magnitude of any voltage present between the input terminals has exceeded a pre-determined level for a first brief period of time; and ii) to cause the short circuit to disappear after a second brief period of time, this second brief period of time being at least ten times longer than the first brief period of time;

such that the control means is operative to provide said effective short circuit across the input terminals whether or not a gas discharge lamp is connected across the ballast terminals.

19. The control means of claim 18 wherein the first brief period of time is shorter than about 25 milliseconds.

20. The control means of claim 18 wherein the shorting means comprises bridge rectifier means and an inverter means operable to be triggered into and out of self-oscillation.

21. The arrangement of claim 18 wherein the shorting means is operative to provide a cathode heating voltage across a pair of auxiliary terminals, but only as long as the shorting means is actually operative to cause a short circuit between the input terminals.

22. A ballast means adapted: i) to be powered from the power line voltage of an ordinary electric utility power line, and ii) to operate a fluorescent lamp means, comprising:

inductor means connected with the power line and operative to provide a current-limited AC voltage at a pair of ballast terminals, the magnitude of this current-limited AC voltage being large enough to permit rapid-start ignition of the fluorescent lamp means, the frequency of this current-limited AC voltage being the same as that of the power line voltage;

connect means operable to connect a fluorescent lamp means across the ballast terminals, the fluorescent lamp means having a thermionic cathode;

control means connected with the ballast terminals, the control means being operative to exist in either of two states: i) a first state wherein it constitutes a relatively low-magnitude impedance and wherein it provides electric heating power to the thermionic cathode, and ii) a second state where it represents a relatively high-magnitude impedance and wherein it does not provide electric heating power to the thermionic cathode; and starting aid electrode being: i) electrically connected with the power line, ii) positioned adjacent the lamp means, and iii) operative to constitute a starting aid for the lamp means;

thereby to cause the lamp means to ignite in a rapid-start manner during a period when the control means exists in its second state, but only after having been preceded by a period during which the control means existed in its first state.

* * * * *